US010251459B2

(12) United States Patent
Lee et al.

(10) Patent No.: US 10,251,459 B2
(45) Date of Patent: Apr. 9, 2019

(54) AIR VIBRATION APPARATUS AND HAIR DRYER COMPRISING THE SAME

(71) Applicant: UNIX ELECTRONICS CO., LTD., Gimpo-si, Gyeonggi-do (KR)

(72) Inventors: Chung Gu Lee, Seoul (KR); Han Jo Lee, Seoul (KR)

(73) Assignee: UNIX ELECTRONICS CO., LTD., Gimpo-si (KR)

( * ) Notice: Subject to any disclaimer, the term of this patent is extended or adjusted under 35 U.S.C. 154(b) by 0 days.

(21) Appl. No.: 15/553,032

(22) PCT Filed: Dec. 21, 2015

(86) PCT No.: PCT/KR2015/014027
§ 371 (c)(1),
(2) Date: Aug. 23, 2017

(87) PCT Pub. No.: WO2016/137104
PCT Pub. Date: Sep. 1, 2016

(65) Prior Publication Data

US 2018/0035779 A1 Feb. 8, 2018

(30) Foreign Application Priority Data

Feb. 24, 2015 (KR) ..... 10-2015-0025636

(51) Int. Cl.
*A45D 20/12* (2006.01)

(52) U.S. Cl.
CPC ..... *A45D 20/124* (2013.01); *A45D 20/12* (2013.01)

(58) Field of Classification Search
CPC ..... A45D 20/124; A45D 20/00; A45D 20/12; A45D 20/20
(Continued)

(56) References Cited

U.S. PATENT DOCUMENTS 4,132,360 A * 1/1979 Lee, Jr. ..... A45D 20/124 239/383
5,054,211 A * 10/1991 Shulman ..... A45D 20/124 239/581.1
(Continued)

FOREIGN PATENT DOCUMENTS

JP 2008295758 A * 12/2008
JP 2014-151045 A 8/2014
(Continued)

OTHER PUBLICATIONS

International Search Report for PCT/KR2015/014027 dated Apr. 1, 2016 [PCT/ISA/210].

*Primary Examiner* — Stephen M Gravini
(74) *Attorney, Agent, or Firm* — Sughrue Mion, PLLC

(57) ABSTRACT

According to an aspect of the present invention, there is provided an air vibration apparatus which is coupled to a blowing port of a hair dryer to vibrate air, the air vibration apparatus including: a pipe-shaped adapter which is coupled to a blowing port and into which air flows; a rotating unit which includes a pipe-shaped rotating body which is rotatably coupled to the inside of the adapter, into which the air flows from one end, and which rotates by means of the air, and a control bar coupled to the rotating body to be extended from the rotating body; and a rotating blade unit which is hinge-coupled to an end portion of the adapter by means of a hinge portion and comes in contact with the control bar to vibrate based on the hinge portion according to the rotation of the rotating body.

11 Claims, 6 Drawing Sheets

(58) Field of Classification Search
USPC ..... 34/96–100
See application file for complete search history.

(56) References Cited

U.S. PATENT DOCUMENTS 5,157,757 A * 10/1992 McDougall ..... A45D 20/122 239/455
5,161,317 A * 11/1992 McDougall ..... A45D 20/124 239/383
5,392,528 A * 2/1995 McDougall ..... A45D 20/124 239/101
5,471,763 A * 12/1995 McArthur ..... A45D 20/124 34/96
D429,374 S * 8/2000 Muller ..... D28/18
6,199,295 B1 * 3/2001 Smal ..... A45D 20/122 34/98
6,966,125 B2 11/2005 Rago et al.
8,082,679 B1 * 12/2011 Arnim ..... A45D 20/12 132/148
8,707,577 B2 * 4/2014 Lee ..... A45D 20/12 132/212
8,732,976 B2 * 5/2014 Han ..... A45D 20/124 34/283
9,072,358 B2 * 7/2015 Han ..... A45D 20/124
2003/0196344 A1 * 10/2003 Park ..... A45D 20/12 34/96
2008/0301968 A1 * 12/2008 Lee ..... A45D 20/12 34/97
2009/0188125 A1 * 7/2009 Fung ..... A45D 20/12 34/68
2013/0104415 A1 * 5/2013 Han ..... A45D 20/00 34/283
2013/0174439 A1 * 7/2013 Ragosta ..... A45D 20/124 34/283
2018/0035779 A1 * 2/2018 Lee ..... A45D 20/124
2018/0036553 A1 * 2/2018 Shiibashi ..... A61N 5/0617

FOREIGN PATENT DOCUMENTS

KR 10-1997-0073437 A 12/1997
KR 10-2013-0053243 A 5/2013
KR 10-1477739 B1 12/2014

* cited by examiner

AIR VIBRATION APPARATUS AND HAIR DRYER COMPRISING THE SAME

CROSS REFERENCE TO RELATED APPLICATIONS

This application is a National Stage of International Application No. PCT/KR2015/014027, filed on Dec. 21, 2015, which claims priority form Korean Patent Application No. 10-2015-0025636, filed on Feb. 24, 2015, the contents of all of which are incorporated herein by reference in their entirety.

TECHNICAL FIELD

The present invention relates to an air vibration apparatus and a hair dryer including the same, and more particularly, to an air vibration apparatus and a hair dryer including the same, which can shorten a drying time of the hair and allow a user to easily use a hair dryer without feeling fatigue by continuously changing a blowing direction of the hair dryer.

BACKGROUND ART

Generally, a hair dryer is used to dry and stylize the user's hair by blowing cold or warm air in a required direction. Basically, in the hair dryer, when power is applied to a main body to operate a switch, the main body sucks air from the atmosphere, the sucked air passes through a heating apparatus and a blowing apparatus, and the air blows to the outside of the main body to dry the user's hair.

In the process of drying the hair using the hair dryer, the user dries the hair while changing the blowing direction of the air of the hair dryer by shaking the hair dryer, but since the user needs to continuously move the hair dryer, there is a problem that the user easily feels fatigue due to the load on the wrist or the arm.

DISCLOSURE

Technical Problem

The present invention relates to an air vibration apparatus and a hair dryer including the same, which can shorten a drying time of the hair and allow a user to easily use a hair dryer without feeling fatigue by continuously changing a blowing direction of the hair dryer.

Technical Solution

According to an aspect of the present invention, there is provided an air vibration apparatus which is coupled to a blowing port of a hair dryer to vibrate air, the air vibration apparatus including: a pipe-shaped adapter which is coupled to a blowing port and into which air flows; a rotating unit which includes a pipe-shaped rotating body which is rotatably coupled to the inside of the adapter, into which the air flows from one end, and which rotates by means of the air, and a control bar coupled to the rotating body to be extended from the rotating body; and a rotating blade unit which is hinge-coupled to an end portion of the adapter by means of a hinge portion and comes in contact with the control bar to vibrate based on the hinge portion according to the rotation of the rotating body.

The rotating unit may include a plurality of vanes formed to be extended from the inner wall of the rotating body toward the center of the rotating body so that the rotating body rotates as the air flows.

The adapter may include a fixing hub coupled to the inside of the adapter, the rotating unit may further include a rotating shaft portion which is disposed in a longitudinal direction at the center of the rotating body and to which the plurality of vanes is extended and coupled, and the rotating shaft portion may be rotatably coupled to the fixing hub.

The rotating blade unit may include a rotating blade hinge-coupled to the end of the adapter and a pipe body having a hollow portion of which one end extended from the end of the rotating blade is opened, and the end of the control bar may be positioned at the hollow portion and periodically contact the inner wall of the hollow portion according to the rotation of the rotating unit to vibrate the rotating blade.

A cross section of the hollow portion of the pipe body may have an oval shape, and the control bar may be eccentrically coupled at the rotation center of the rotating body to contact the inner wall of a short axis of the oval-shaped hollow portion.

The rotating blade may include a pair of hinge shafts extended from both sides of the rotating blade, and the hinge portions may include a pair of hinge fixing portions which are extended to the end of the adapter to face each other and to which the pair of hinge shafts are rotatably coupled, respectively.

The air vibration apparatus may further include a stopper which is coupled to the hinge fixing portion to slide against the hinge fixing portion and controls the vibration of the rotating blade according to the sliding.

The stopper may include a fixing button coupled to slide against the hinge fixing portion; and a fixing body which is interlocked with the fixing button and has a fixing groove formed detachably at the lower end of the rotating blade.

The air vibration apparatus may further include a nozzle of which one end is detachably coupled to the adapter and the other end has a discharge port discharging the air ejected through the rotating unit to the outside.

According to another aspect of the present invention, there is provided a hair dryer including: a hair dryer main body having a blowing port ejecting air; and an air vibration apparatus which is coupled to the blowing port to vibrate the air.

The adapter may be integrally formed with the blowing port.

Advantageous Effects

According to the exemplary embodiment of the present invention, it is possible to shorten a drying time of the hair and allow a user to easily use the hair dryer without feeling fatigue by continuously changing a blowing direction of the hair dryer.

MODES OF THE INVENTION

Figure 1:
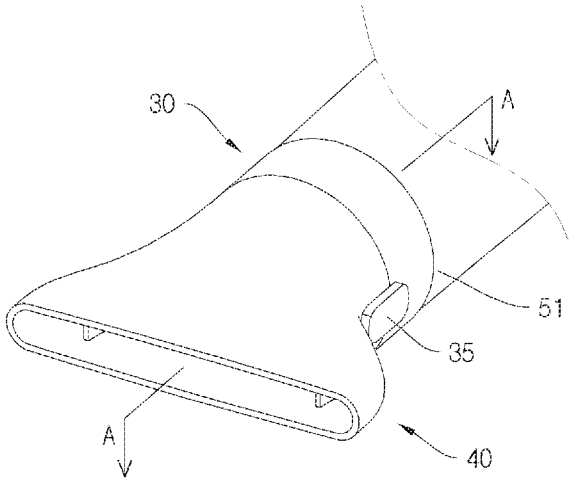
FIG. 1 is a perspective view of an air vibration apparatus according to an exemplary embodiment of the present invention.

The present invention may have various modifications and various exemplary embodiments and specific exemplary embodiments will be described in detail in the detailed description. However, this does not limit the present invention to specific exemplary embodiments, and it should be understood that the present invention covers all the modifications, equivalents and replacements included within the idea and technical scope of the present invention. In describing the present invention, when it is determined that the detailed description of the publicly known art related to the present invention may obscure the gist of the present invention, the detailed description thereof will be omitted.

Hereinafter, an air vibration apparatus and a hair dryer including the same according to the present invention will be described in detail with reference to the accompanying drawings, and in the description with reference to the accompanying drawings, like or corresponding components designate like reference numerals, and a duplicate description thereof will be omitted.

Figure 2:
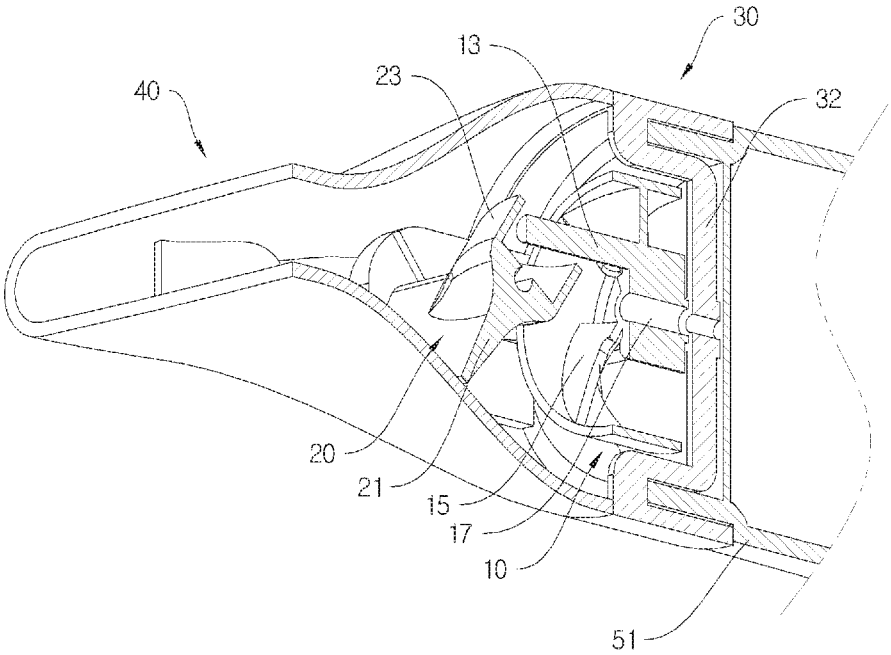
FIG. 2 is a cutout view of the air vibration apparatus according to the exemplary embodiment of the present invention.
Figure 3:
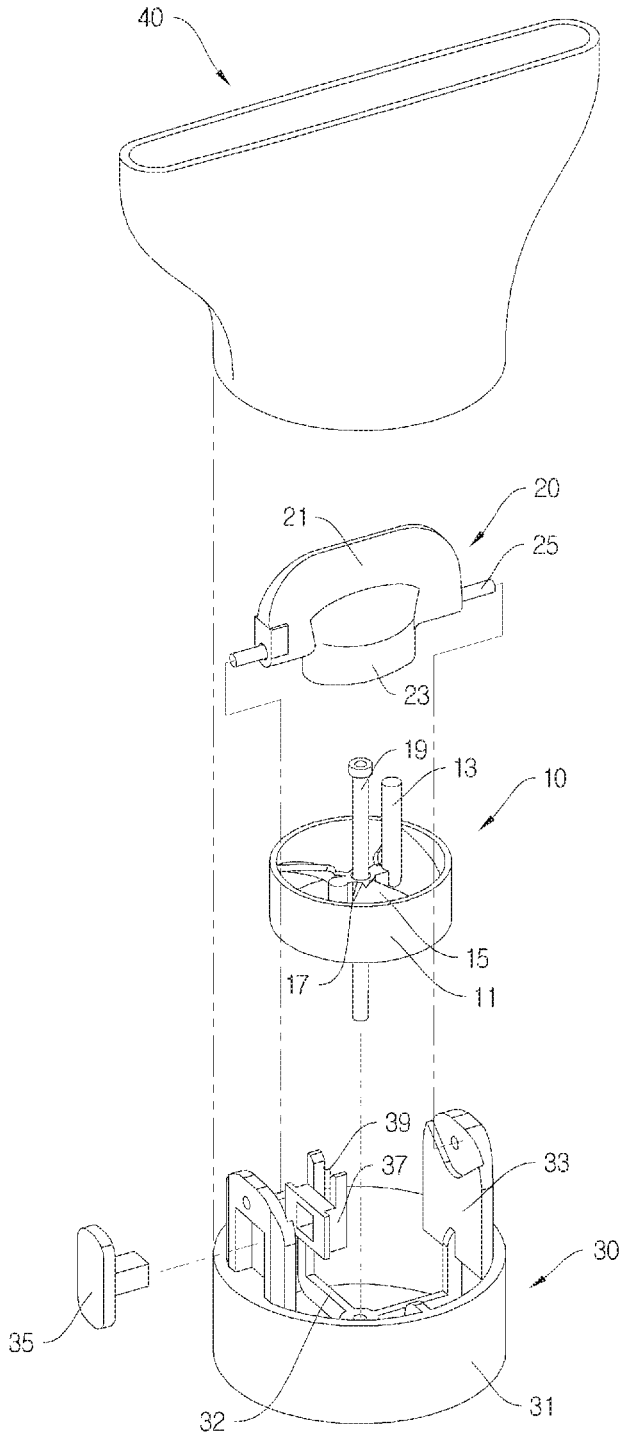
FIG. 3 is an exploded perspective view of the air vibration apparatus according to the exemplary embodiment of the present invention.
Figure 4:
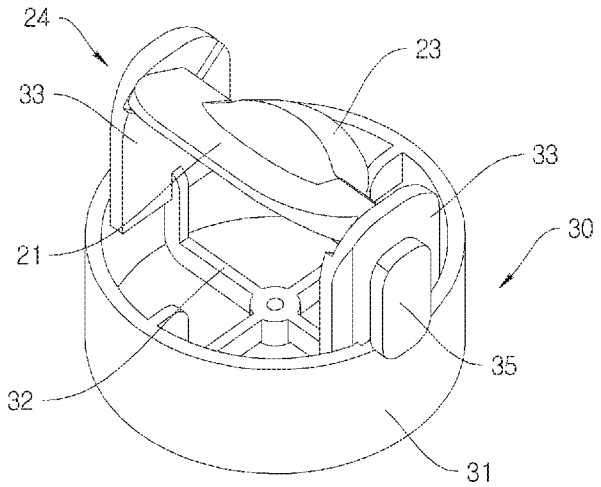
FIG. 4 is a perspective view of an adaptor of the air vibration apparatus according to the exemplary embodiment of the present invention.
Figure 5:
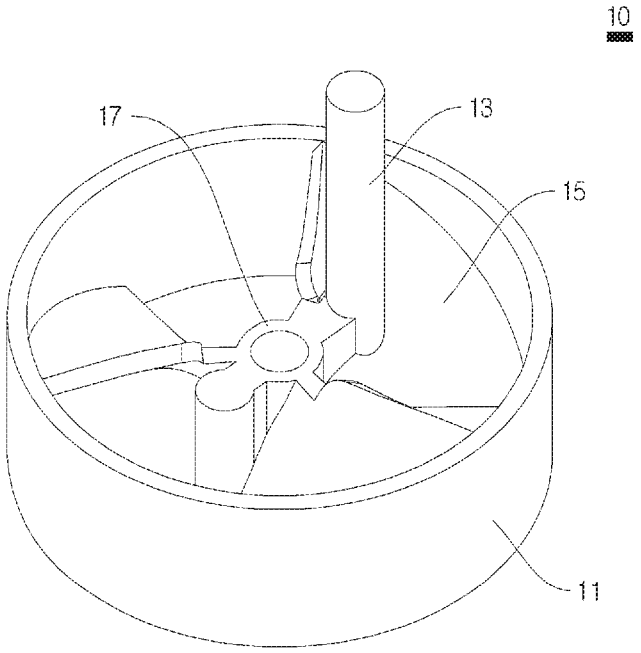
FIG. 5 is a perspective view of a rotating unit of the air vibration apparatus according to the exemplary embodiment of the present invention.
Figure 6:
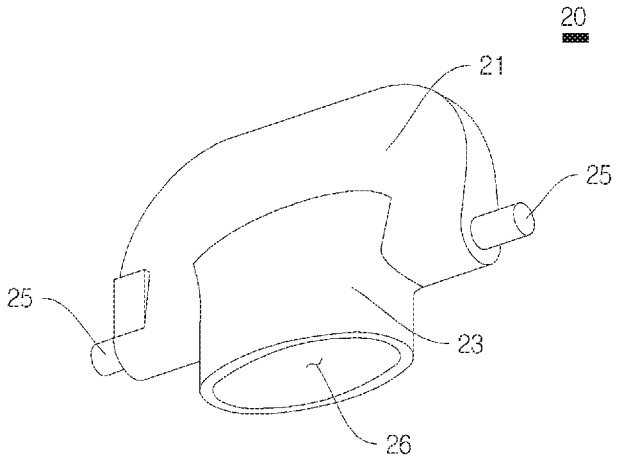
FIG. 6 is a perspective view of a rotating blade unit of the air vibration apparatus according to the exemplary embodiment of the present invention.
Figure 7:
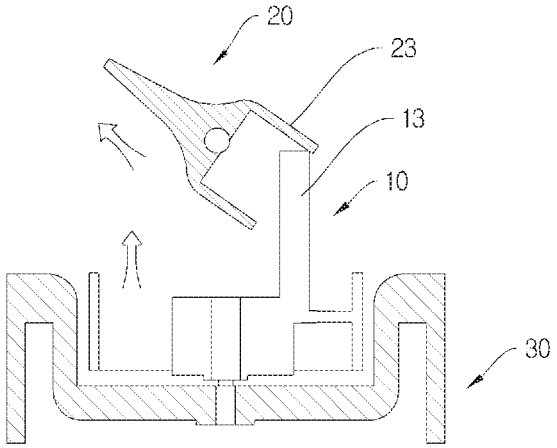
FIGS. 7 to 9 are views for describing an operating process of the air vibration apparatus according to the exemplary embodiment of the present invention.
Figure 8:
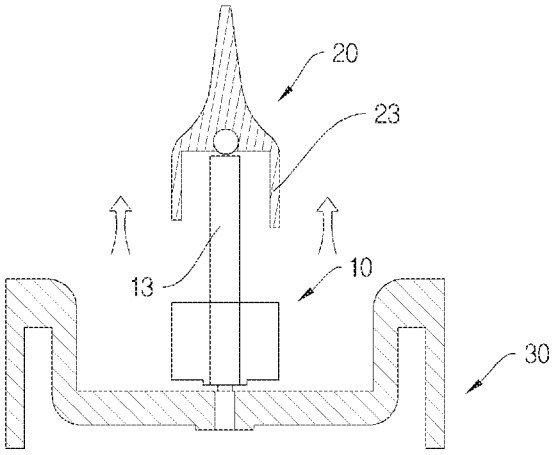
Figure 9:
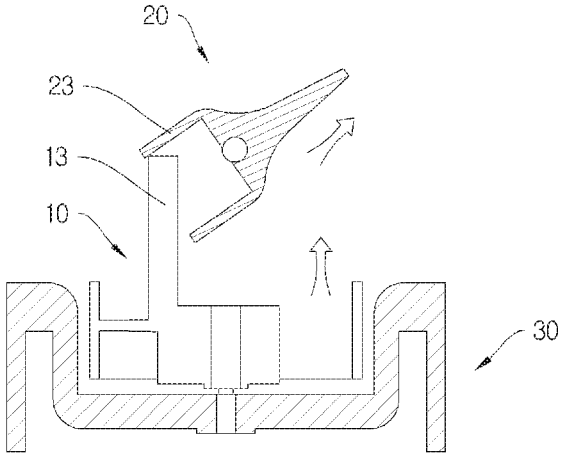

FIG. 1 is a perspective view of an air vibration apparatus according to an exemplary embodiment of the present invention, FIG. 2 is a cutout view of the air vibration apparatus according to the exemplary embodiment of the present invention, and FIG. 3 is an exploded perspective view of the air vibration apparatus according to the exemplary embodiment of the present invention. In addition, FIG. 4 is a perspective view of an adaptor of the air vibration apparatus according to the exemplary embodiment of the present invention, FIG. 5 is a perspective view of a rotating unit of the air vibration apparatus according to the exemplary embodiment of the present invention, and FIG. 6 is a perspective view of a rotating blade unit of the air vibration apparatus according to the exemplary embodiment of the present invention. In addition, FIGS. 7 to 9 are views for describing an operating process of the air vibration apparatus according to the exemplary embodiment of the present invention. In addition, FIG. 10 is a perspective view of a hair dryer including the air vibration apparatus according to the exemplary embodiment of the present invention.

In FIGS. 1 to 10, an air vibration apparatus 1, a hair dryer main body 5, a rotating unit 10, a rotating body 11, a control bar 13, a vane 15, a rotating shaft portion 17, a coupling pin 19, a rotating blade unit 20, a rotating blade 21, a pipe body 23, a hinge portion 24, a hinge shaft 25, 26, a hollow portion 26, an adapter 30, an adapter body 31, a fixing hub 32, a hinge fixing portion 33, a fixing button 35, a fixing body 37, a fixing groove 39, a nozzle 40, and a blowing port 51 are illustrated.

Figure 10:
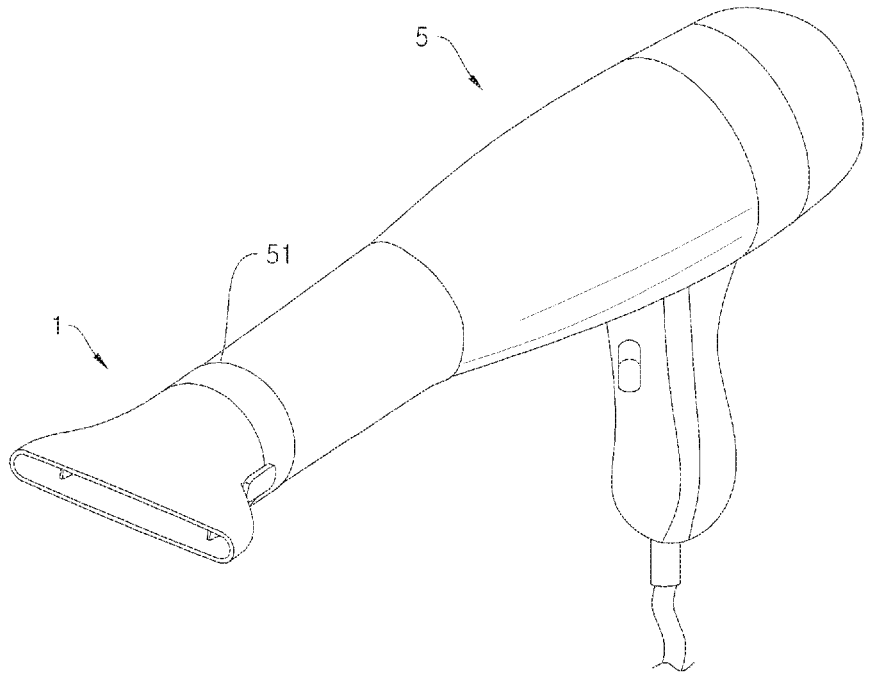
FIG. 10 is a perspective view of a hair dryer including the air vibration apparatus according to the exemplary embodiment of the present invention.

The hair dryer according to the exemplary embodiment includes the hair dryer main body 5 and the air vibration apparatus 1 (see FIG. 10).

In the hair dryer main body 5, an air suction port sucking external air, a blowing apparatus installed with a motor, a fan, and the like which blow the sucked air to the blowing port 51, a heating apparatus heating the sucked air, and a switch adjusting power, a temperature, and the like may be provided, and the user may use the hair dryer by holding a handle formed on the hair dryer main body 5.

The blowing port 51 is formed at one side of the hair dryer main body 5 to blow air generated from the hair dryer main body 5 to the outside. The air vibration apparatus 1 according to the exemplary embodiment is coupled to the blowing port 51 to vibrate the air discharged from the blowing port 51 and blow the air to the outside.

Hereinafter, the air vibration apparatus 1 according to the exemplary embodiment of the present invention will be described in detail.

The air vibration apparatus 1 according to the exemplary embodiment is the air vibration apparatus 1 which is coupled to the blowing port 51 of the hair dryer to vibrate the air, and includes a pipe-shaped adaptor 30 which is coupled to the blowing port 51 and into which air flows; a rotating unit 10 which includes a pipe-shaped rotating body 11 which is rotatably coupled to the inside of the adapter 30, into which the air flows from one end, and which rotates by means of the air, and a control bar 13 coupled to the rotating body to be extended from the rotating body 11; and a rotating blade unit 20 which is hinge-coupled to an end portion of the adapter 30 by means of a hinge portion 24 and comes in contact with the control bar 13 to vibrate based on the hinge portion 24 according to the rotation of the rotating body 11.

The adapter 30 has a pipe shape and is coupled to the blowing port 51 of the hair dryer. The adapter 30 may have a pipe shape having an annular cross section, one end is coupled to the blowing port 51, and the air flowing from the hair dryer main body 5 is discharged to the other end through a hollow inside. The adapter 30 may be coupled to the blowing port 51 by various methods such as tight fitting, screw coupling, and the like.

The adapter 30 may have a pipe-shaped adapter body 31 and a fixing hub 32 coupled to the inside of the adapter body 31. The fixing hub 32 is to rotatably support the rotating unit 10 to be described below.

The rotating unit 10 includes the pipe-shaped rotating body 11 which is rotatably coupled to the inside of the adapter 30, into which the air flows from one end, and which rotates by means of the air and the control bar 12 coupled to the rotating body 11 to be extended from the rotating body 11. The rotating body 11 positioned in the adapter 30 rotates by the air flowing to the adapter 30, and the control bar 13 extended from the rotating body 11 comes in contact with the rotating blade unit 20 to be described below while rotating by rotating the rotating body 11, and then the rotating blade unit 20 vibrates with periodic tilting.

Referring to FIG. 5, the rotating body 11 has a pipe shape and a spiral vane 15 may be formed in the rotating body 11 to be extended from the inner wall of the rotating body 11 toward the center of the rotating body 11. The vane 15 is inclined at a predetermined angle and the air flowing into the rotating body 11 hits the vane 15 to rotate the rotating body 11. The vane 15 may be formed in a longitudinal direction of the rotating body 11 in order to increase resistance.

Meanwhile, the rotating unit 10 may have the rotating shaft portion disposed in a longitudinal direction at the center of the rotating body 11. The rotating shaft portion 17 is disposed at the center of the rotary body 11 and a plurality of vanes 15 extended in the center direction of the rotary body 11 are coupled to the rotating shaft portion 17 to be extended from the rotating shaft portion 17.

The fixing hub 32 for supporting the rotating shaft portion 17 may be coupled to the inside of the adapter 30, and the rotating shaft portion 17 of the rotating unit 10 is rotatably coupled to the fixing hub 32 and then, the rotating unit 10 is rotated inside the adapter 30 when the air flows to the rotating unit 10.

In order to coupling of the rotating unit 10 to the fixing hub 32, through holes may be formed in a longitudinal direction in the rotating shaft portion 17, and while the end of the coupling pin 19 is coupled to the fixing hub 32 through the through holes of the rotating shaft portion 17, the rotating unit 10 is rotatably supported to the fixing hub 32.

The rotating blade unit 20 is hinge-coupled to the end of the adapter 30 by the hinge portion 24 and comes in contact with the control bar 13 of the rotating unit 10 to vibrate with periodic tilting based on the hinge portion 24 as the rotating body 11 rotates. The rotating blade unit 20 is hinge-coupled to the end of the adapter 30 and rotates together with the control bar 13 of the rotating unit 10 as the rotating body 11 rotates, and while the rotating control bar 13 periodically contacts the rotating blade unit 20, the rotating blade unit 20 is tilted based on the hinge portion 24. While the direction of the air passing through the rotating unit 10 is changed by the periodic titling of the rotating blade unit 20, the air is blown from the hair dryer.

The rotating blade unit 20 according to the exemplary embodiment includes the rotating blade 21 hinge-coupled to the end of the adapter 30 and the pipe body 23 having the hollow portion 26 of which one end extended from the end of the rotating blade 21 is opened. The end of the control bar 13 is positioned at the hollow portion 26 of the pipe body 23 and the control bar 13 periodically contacts the inner wall of the hollow portion 26 while the rotating bar 13 rotates by the rotation of the rotating unit 10 to vibrate the rotating blade 21.

For hinge-coupling of the rotating blade unit 20 and the adapter 30, the rotating blade 21 has a pair of hinge shafts 25 extended from both sides of the rotating blade 21 and the hinge portions 24 may include a pair of hinge fixing portions 33 which are extended to the end of the adapter 30 to face each other and to which the pair of hinge shafts 25 are rotatably coupled, respectively.

Referring to FIG. 4, the pair of hinge shafts 25 protruding outward from the both sides of the rotating blade 21 are hinge-coupled to the pair of hinge fixing portions 33 formed to be extended to the end of the adapter 30 to face each other, respectively. A hinge hole to which the hinge shaft 25 may be inserted is formed in each hinge fixing portion 33, and while the hinge shafts 25 protruding from both ends of the rotating blade 21 are inserted into the hinge holes of the hinge fixing portion 33, respectively, the rotating blade unit 20 is hinge-coupled to the adapter 30.

Meanwhile, the cross section of the hollow portion 26 of the pipe body 23 of the rotating blade unit 20 according to the exemplary embodiment has an oval shape and the control bar 13 is eccentrically coupled at the rotation center of the rotating body 11 to contact the inner wall of a short axis of the oval-shaped hollow portion 26. While the control bar 13 eccentrically coupled at the rotation center periodically contacts the inner wall of the short-axial direction of the oval of the hollow portion 26 according to the rotation of the rotating unit 10, the rotating blade unit 20 is tilted to change periodically the direction of the air discharged from the blowing port 51.

Referring to FIGS. 7 to 9, when describing the process of tilting the rotating blade 21 according to the rotation of the rotating unit 10, as illustrated in FIG. 7, in the case where the control bar 13 is positioned in the short-axial direction of one side of the oval, the control bar 13 presses the inner wall of the short-axial direction of one side of the oval and then the rotating blade unit 20 is tilted in the other direction of the oval based on the hinge shaft 25. In addition, as illustrated in FIG. 8, when the control bar 13 is positioned in a long-axial direction of the oval of the hollow portion 26 according to the rotation of the rotating unit 10, the control bar 13 and the rotating blade unit 20 do not contact each other, and as a result, the rotating blade unit 20 stands upright in the direction of the wind flowing into the rotating unit 10. In addition, as illustrated in FIG. 9, when the control bar 13 is positioned in the short-axial direction of the other side of the oval according to the rotation of the rotating unit 10, the control bar 13 presses the inner wall in the short-axial direction of the other side of the oval, and as a result, the rotating blade unit 20 is tilted in the direction of one side of the oval based on the hinge shaft 25. While the rotating blade unit 20 is repeatedly tilted based on the hinge shaft 25 in the same manner according to the continuous rotation of the rotating unit 10, the rotating blade unit 20 periodically vibrates in the direction of the air discharged from the blowing port 51.

The end of the control bar 13 may be made of an elastic material by considering friction that may occur when contacting the inner wall of the hollow portion 26.

In the nozzle 40, one end is detachably coupled to the adapter 30 and a discharge port discharging the air ejected through the rotating unit 10 to the outside is formed at the other end. The discharging port of the nozzle 40 may be formed in a slot shape elongated in one direction, and the air ejected through the rotating unit 10 is blown while vibrating by the rotating blade unit 20 and vibrating through the discharging port of the nozzle 40.

The air vibration apparatus 1 according to the exemplary embodiment may include a stopper which is coupled to the hinge fixing portion 33 to slide against the hinge fixing portion 33 of the adapter 30 and controls the vibration of the rotating blade 21 according to the sliding. The air ejected from the hair dryer does not vibrate by the user's selection to use the hair dryer and the air is uniformly discharged without vibration by stopping the rotation of the rotating unit 20 by using the stopper 40.

Referring to FIGS. 3 and 4, the stopper may include a fixing button 35 coupled to slide against the hinge fixing portion 33 and a fixing body 37 which is interlocked with the fixing button 35 and has a fixing groove 39 formed detachably at the lower end of the rotating blade 21. The fixing button 35 is slidably coupled to the outer surface of the hinge fixing portion 33 and the fixing body 37 is interlocked with the sliding of the fixing button 35 to control the tilting of the rotating blade 21.

An opening is formed in the hinge fixing portion 33, a part of the fixing button 35 is through-inserted to the opening, and the fixing body is positioned between the adapter 30 and the rotating unit 10 to be coupled to the part of the fixing button 35 passing through the opening, and then the fixing body 37 is interlocked and moved according to the reciprocating sliding of the fixing button 35. The fixing body 37 has the fixing groove 39, and the lower end of the rotating blade 21 is inserted to the fixing groove 39 or separated from the fixing groove 39 according to the movement of the fixing body 37 to fix or release the rotating blade 21. That is, when the fixing body 37 slides to one side and the lower portion of the rotating blade 21 is inserted into the fixing groove 39, the rotating blade 21 is fixed and stands upright, and as a result, the rotating blade 21 coupled to the control bar 12 stops the rotation. In addition, when the fixing body 37 slides to the other side and the rotating blade 21 is separated from the rotating blade 21, the rotating blade 21 is tilted and vibrates by the hinge-coupling of the hinge portion 24.

In the above exemplary embodiment, as described above, a form in which the air vibration apparatus 1 is detachably coupled to the hair dryer by configuring the air vibration apparatus 1 separately from the hair dryer is proposed, but further, the hair dryer and the air vibration apparatus 1 may be integrally configured. That is, the adapter 30 as a part of the air blowing port 51 is integrally configured with the blowing port 51, and the rotating unit 10, the rotating blade unit 20, the nozzle 40, and the like are coupled to the inside of the blowing port 51, and thus the air vibration apparatus 1 is integrally configured with the hair dryer.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

The invention claimed is:

1. An air vibration apparatus that is coupled to a blowing port of a hair dryer to vibrate air, the air vibration apparatus comprising:

a pipe-shaped adaptor which is coupled to the blowing port and into which the air flows;

a rotating unit which includes a pipe-shaped rotating body which is rotatably coupled to an inside of the adapter, into which the air flows from one end, and which rotates by the air, and a control bar coupled to the rotating body to be extended from the rotating body; and a rotating blade unit which is hinge-coupled to an end portion of the adapter by a hinge portion and comes in contact with the control bar to vibrate based on the hinge portion according to the rotation of the rotating body.

2. The air vibration apparatus of claim 1, wherein the rotating unit includes a plurality of vanes formed to be extended from an inner wall of the rotating body toward a center of the rotating body so that the rotating body rotates as the air flows.

3. The air vibration apparatus of claim 2, wherein the adapter includes a fixing hub coupled to the inside of the adapter, the rotating unit further includes a rotating shaft portion which is disposed in a longitudinal direction at the center of the rotating body and to which the plurality of vanes is extended and coupled, and the rotating shaft portion is rotatably coupled to the fixing hub.

4. The air vibration apparatus of claim 1, wherein the rotating blade unit includes a rotating blade hinge-coupled to the end portion of the adapter and a pipe body having a hollow portion of which one end extended from an end of the rotating blade is opened, and an end of the control bar is positioned at the hollow portion and periodically contacts an inner wall of the hollow portion according to rotation of the rotating unit to vibrate the rotating blade.

5. The air vibration apparatus of claim 4, wherein a cross section of the hollow portion of the pipe body has an oval shape, and the control bar is eccentrically coupled at a rotation center of the rotating body to contact an inner wall of a short axis of the oval-shaped hollow portion.

6. The air vibration apparatus of claim 4, wherein the rotating blade includes a pair of hinge shafts extended from both sides of the rotating blade, and the hinge portion include a pair of hinge fixing portions which are extended to the end portion of the adapter to face each other and to which the pair of hinge shafts are rotatably coupled, respectively.

7. The air vibration apparatus of claim 6, further comprising:

a stopper which is coupled to one of the hinge fixing portions to slide against the one of the hinge fixing portions and controls the vibration of the rotating blade according to sliding of the stopper.

8. The air vibration apparatus of claim 7, wherein the stopper includes a fixing button coupled to one of the hinge fixing portions to slide against the one of the hinge fixing portions; and a fixing body which is interlocked with the fixing button and has a fixing groove formed detachably at the end of the rotating blade.

9. The air vibration apparatus of claim 1, further comprising a nozzle, wherein one end of the nozzle is detachably coupled to the adapter and an opposite end of the nozzle has a discharge port discharging the air ejected through the rotating unit to an outside of the air vibration apparatus.

10. A hair dryer, comprising:

a hair dryer main body having a blowing port ejecting air; and the air vibration apparatus which is coupled to the blowing port to vibrate the air according to any one of claims 1 to 9.

11. The hair dryer of claim 10, wherein the adapter is integrally formed with the blowing port.

* * * * *